US007343774B2

(12) United States Patent
Gascoin et al.

(10) Patent No.: US 7,343,774 B2
(45) Date of Patent: Mar. 18, 2008

(54) COMB SYSTEM FOR TOOL SPACERS

(76) Inventors: Eric Gascoin, 9 Rue des Chaudinières, 37230 Luynes (FR); Jean-Louis Fourmy, Les Salardières, Route de Lavernat, 72360 Mayet (FR)

( * ) Notice: Subject to any disclaimer, the term of this patent is extended or adjusted under 35 U.S.C. 154(b) by 369 days.

(21) Appl. No.: 10/658,066

(22) Filed: Sep. 9, 2003

(65) Prior Publication Data

US 2004/0103710 A1 Jun. 3, 2004

(51) Int. Cl.
*B21D 37/04* (2006.01)

(52) U.S. Cl. ..... 72/482.2; 72/482.1; 72/462

(58) Field of Classification Search ..... 72/462, 72/481.1, 481.2, 482.1, 482.2, 482.93, 482.91
See application file for complete search history.

(56) References Cited

U.S. PATENT DOCUMENTS 4,437,654 A * 3/1984 Chiappetti ..... 269/283
4,572,564 A * 2/1986 Cipolla ..... 294/88
4,752,063 A * 6/1988 Nagy ..... 269/266
5,022,256 A * 6/1991 van der Meulen ..... 72/482.91
6,003,360 A * 12/1999 Runk et al. ..... 72/482.2
6,170,813 B1 * 1/2001 Bowers ..... 269/282
6,644,090 B2 * 11/2003 Gasparini ..... 72/482.2
6,953,188 B2 * 10/2005 Siegel ..... 269/266

FOREIGN PATENT DOCUMENTS

FR 2 809 976 A 12/2001

* cited by examiner

*Primary Examiner*—Daniel C Crane
(74) *Attorney, Agent, or Firm*—James Ray & Assoc.

(57) ABSTRACT

The invention relates to a system for fixing a bending tool (34), said tool comprising a retaining groove (38).

The system comprises a clamping body (12) able to collaborate with one of the fixing surfaces of the tool and a tool clamp (20) mounted to pivot, said clamp being able to adopt a first tool clamping position and a second position for mounting/dementing the tool, and a tool retaining member comprising a plurality of elastically deformable blades (58), each blade comprising a first end (58*a*) secured to the clamping body, a running part (58*b*), a second end (58*c*) comprising at least a first angled part (64) angled toward to the tool with respect to the running part and a second angled part (66) angled in the opposite direction so that said angled parts, when said blade is at rest, are held elastically in the groove of the tool.

6 Claims, 2 Drawing Sheets

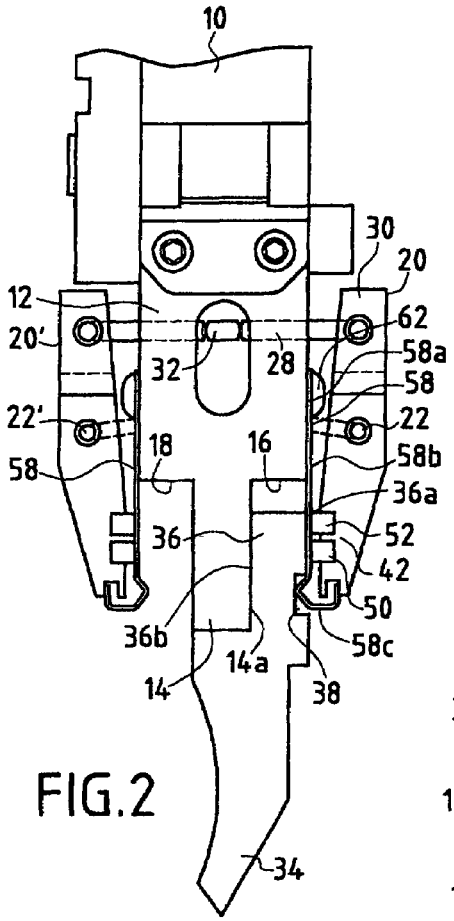
FIG.2
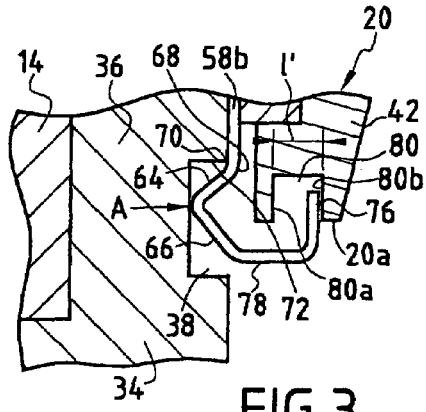
FIG.3
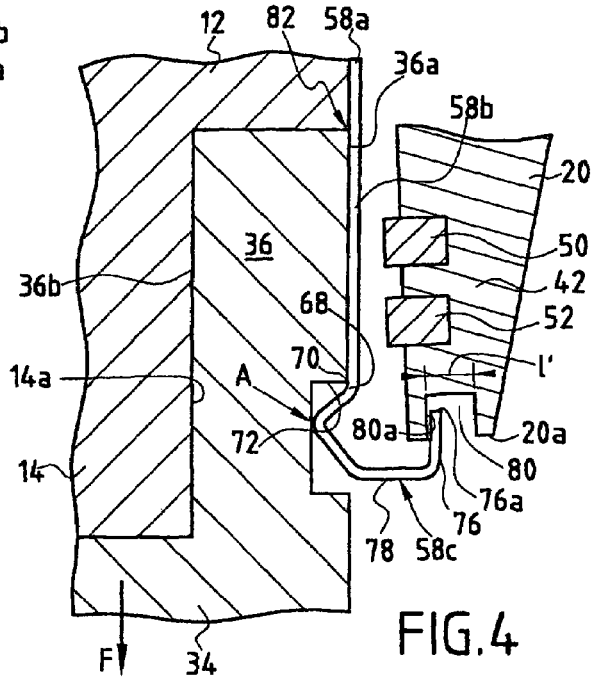
FIG.4
FIG. 5
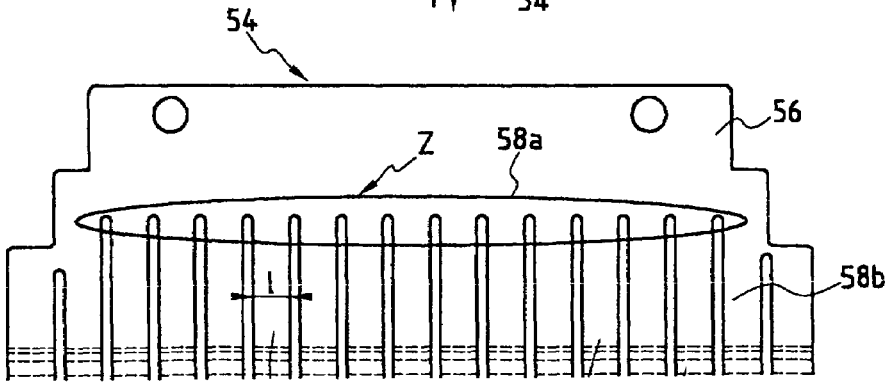

COMB SYSTEM FOR TOOL SPACERS

The present invention relates to a fixing system for mounting and dementing a bending tool on the upper beam of a bending press.

Bending presses are used for the forming of materials in sheet form and for that comprise one or several tools commonly known as punches fixed on the moving beam of the machine by a fixing system or tool holder and, facing these tools, one or several V-shaped dies fixed on the upper edge of the lower beam of the bending press.

By positioning the sheet that is to be formed on the die and lowering the punch by a predetermined amount, the sheet can be bent to the desired angle.

Furthermore, the tool used differs according to the type of forming and the size of forming to be effected on the sheet-formed materials. It is therefore necessary to be able to demount the tool from the top beam, that is to say from the fixing system and replace it with another more suitable tool.

As is well known, the fixing of the tool which comprises a fixing heel is performed using a clamp mounted to pivot which can occupy a first tool-clamping position or a second separated position allowing the tool to be changed.

It will also be understood that bending tools are relatively heavy. It is therefore highly desirable for the tool to be held on the clamp even when this clamp is in the unclamped position, so as to avoid any risk of the tool dropping onto the die of the lower beam arranged facing this tool.

French patent application 00 07 415 in the name of the applicant company describes one embodiment of a tool holder or tool fixing system that allows effective control over the pivoting of the clamp and retention of the tool after the clamp has been unclamped.

The appended FIGS. 1A and 1B depict the embodiment of the tool fixing system described in the above-mentioned patent application. These figures depict the moving upper beam 10 and the tool spacer 12 fixed by any appropriate means to the upper beam 10. The tool spacer comprises a lower part 14 of smaller thickness defined by two shoulders 16 and 18.

The fixing system also comprises a clamp 20 mounted to pivot about a horizontal axis parallel to the length of the beam. The pivot axis may be defined by ball-headed screws 22 collaborating with corresponding bore holes 24 machined in the middle part 26 of the clamp 20. To cause the clamp 20 to pivot about the axis defined by the heads of the ball-headed screws 22, use may be made of push-rods 28, one end of which acts on the upper end 30 of the clamp 20 and the second end of which collaborates with a rotary cam 32 mounted in the tool spacer 12 in the longitudinal direction of the beam. In this embodiment, the cam 32, in the position depicted in FIG. 1A, causes the upper part 30 of the clamp to move away, and this corresponds to the clamped position. By contrast, in its position depicted in FIG. 1B, the cam 32 no longer acts on the push-rods 30 and, under the effect of an elastic system, the clamp 20 adopts the position for mounting-dementing the tool, which position is depicted in FIG. 1B.

The tool 34 comprises at its upper part a fixing heel 36 which has a first fixing face 36*a*, a second fixing face 36*b* parallel to the first fixing face and a retaining groove 38.

In the clamped position depicted in FIG. 1A, the fixing surfaces 36*a* and 36*b* of the heel of the tool are trapped between the clamping face 14*a* of the end 14 of the tool spacer and the clamping face 40 of the lower part 42 of the clamp 20.

Furthermore, at its lower end 42, the clamp comprises a retaining means 44 in the form of a nib that can enter a groove 38 in the heel of the tool 34. When the clamp 20 is in the clamped position depicted in FIG. 1A, the nib 44 has no effect. By contrast, when the lower end 42 of the clamp is moved away to occupy the mounting-dementing position, the nib 44 remains partially engaged in the groove 38, and this keeps the tool 34 in a vertical direction with respect to the tool spacer 12.

This system allows effective retention of the tool preventing it from falling out, but nonetheless has the following disadvantage. When the clamp 20 is brought into its mounting-dementing position, the tool 34 can be removed only via the longitudinal ends of the clamp 20 by sliding the heel of the tool between the clamp and the lower part 14 of the tool spacer.

It will be understood that, because the tool can be fitted between the lower part of the tool spacer and the clamp only laterally, that is to say from the ends of the clamp, when the operator wishes to replace a tool which is mounted, for example, in the central part of the clamp, he has first of all to demount the tools arranged between the tool that actually needs to be changed and one of the ends of the clamp.

These relatively tricky operations of removing a plurality of tools appreciably increase the time spent changing the desired tool and therefore lead to a loss of productivity of the bending press. The higher the frequency at which the tools need to be changed, the more time is lost.

One object of the present invention is to provide a system for fixing a tool to the top beam of a bending press that allows the tools to be mounted and demounted frontally on the top beam, thus making it possible actually to change only the required tool.

Another object of the invention is to provide a tool fixing system in which the tool retaining means are simple and inexpensive to manufacture and easy to mount on the press.

To achieve this objective, according to the invention, the system for fixing a bending tool, said tool comprising two parallel surfaces for fixing by clamping and a retaining groove, comprises a clamping body having a first clamping surface able to collaborate with one of the fixing surfaces of the tool and a tool clamp mounted so that it can pivot and comprising a second clamping surface, said clamp being able to adopt a first tool clamping position in which the fixing surfaces of the tool are clamped between the first and second clamping surfaces and a second position for mounting/dementing the tool, in which position its clamping surface is separated from the first clamping surface of the clamping body.

This fixing system is one which further comprises a tool retaining member comprising a number of mutually parallel elastically deformable blades arranged in the same plane, each blade comprising a first end secured to the clamping body, a running part arranged in such a way that it is pressed against the first fixing face of the tool and a second end comprising at least a first angled part angled toward the tool with respect to the running part and a second angled part angled in the opposite direction so that said angled parts, when said blade is at rest, are held elastically in the groove of the tool and so that when the clamp is in the loading/unloading position, the running part of the blade can deform elastically to allow said angled parts of the elastically deformable blades to be introduced into or extracted from said groove.

It will be understood that, by virtue of the presence of the elastic retaining blades which end in the two angled portions, it is possible to fit and withdraw a bending tool from the front face of the bending machine. Indeed, having brought the clamp into its mounting/dementing position, the tool can be fitted or withdrawn by elastic deformation of the running part of the blades under the effect of the collaboration in one direction or the other of one or other of the angled portions at the end of the elastic blade with the fixing heel of the tool. In addition, this elastic retention system ensures that the tool is held as effectively as it was in the systems of the prior art once the clamp has been unclamped.

Furthermore, it is clearly evident that the cost of manufacture and of mounting of the retaining piece is low because this is preferably a simple metal sheet cut and bent to obtain the various elastic blades with their two angled parts able to enter the tool retaining groove.

Finally, it will be understood that the presence of the two angled parts allows easy insertion and extraction of the retaining means into and from the retaining groove, thus avoiding the risk of stressing or deforming the elastic blades, as such actions would be prejudicial to the life of the retaining system.

As a preference, when a tool is in the fixed position, the running part of the elastic blade bears against the fixing surface of the tool and the first angled portion is in contact with the chamfer which connects the fixing surface of the tool and the upper wall of the groove.

Also as a preference, each elastically deformable blade further comprises, beyond said second angled portion, a connecting portion and an alignment portion arranged at the end of the connecting part, said alignment portion running roughly parallel to the running part of the blade facing at least said second angled portion, said alignment part being able to enter an alignment groove formed in the lower face of the clamp and parallel to the axis of pivoting thereof.

Again according to a preferred embodiment, said alignment groove comprises an alignment wall which collaborates with the alignment portion of the elastically deformable blades when the clamp is in its loading/unloading position.

It will be understood that, by virtue of the presence of the alignment wall formed in the alignment groove of the clamp, the alignment portions of the elastically deformable blades can actually all be aligned and the same therefore can be said of the angled portions of the elastically deformable blades, thus making fitting or extracting the bending tool far easier.

Other characteristics and advantages of the invention will become better apparent from reading the description which follows of one embodiment of the invention given by way of nonlimiting example. The description refers to the attached figures in which:

FIGS. 1A and 1B already described show a system for fixing a bending tool of known type in the active position and in the rest position;

FIG. 2 is an elevation of the entirety of a tool fixing system according to the invention;

FIG. 3 is a detail view showing the lower end of the retaining blades when the clamp is in the clamped position;

FIG. 4 is a detail view showing the lower end of the retaining blade when the clamp is in the mounting/dementing position; and FIG. 5 is an elevation of a preferred embodiment of the retaining member.

Figure 1A:
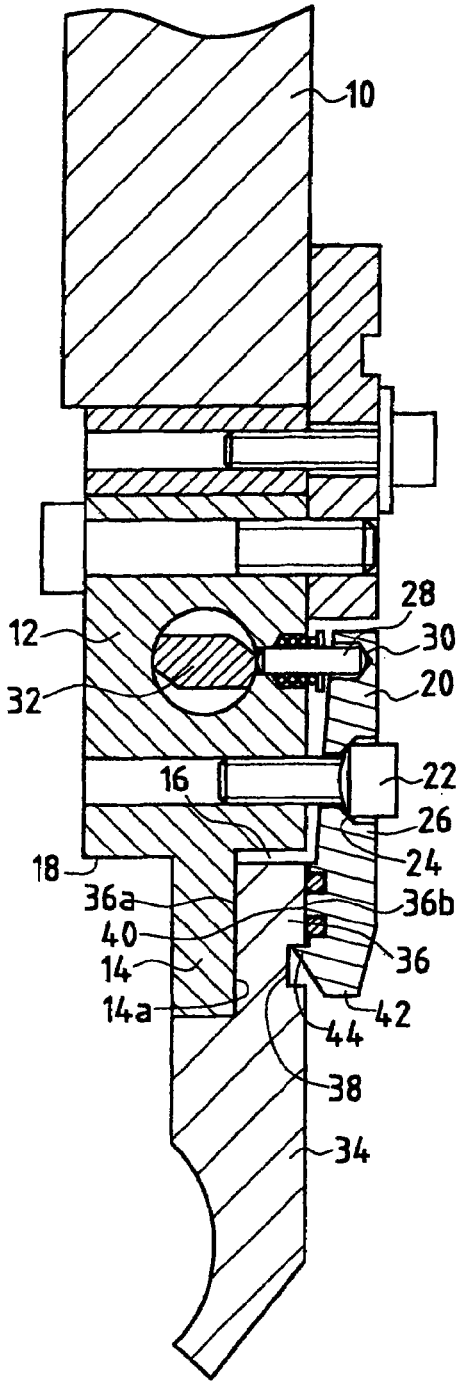
FIG.1A PRIOR ART

Referring first of all to FIG. 2, a description will be given of the entirety of the tool fixing system. This FIG. 2 again shows the upper beam 10 of the bending press, the tool spacer 12 with its reduced-width lower portion 14 defined by the shoulders 16 and 18, the lower part 14 defining one of the clamping faces 14*a*. It also again shows the clamp 20, 20' with its upper part 30 and its lower end 42. FIG. 2 schematically depicts the axis of pivoting 22, 22' of the clamps 20, 20' and of the actuators 28, 32 for controlling the pivoting of each clamp about the axes 22, 22'. The axes 22, 22' and the means for controlling the pivoting of the clamp can be embodied in any way, for example in the kind of way depicted in FIGS. 1A and 1B.

Figure 1B:
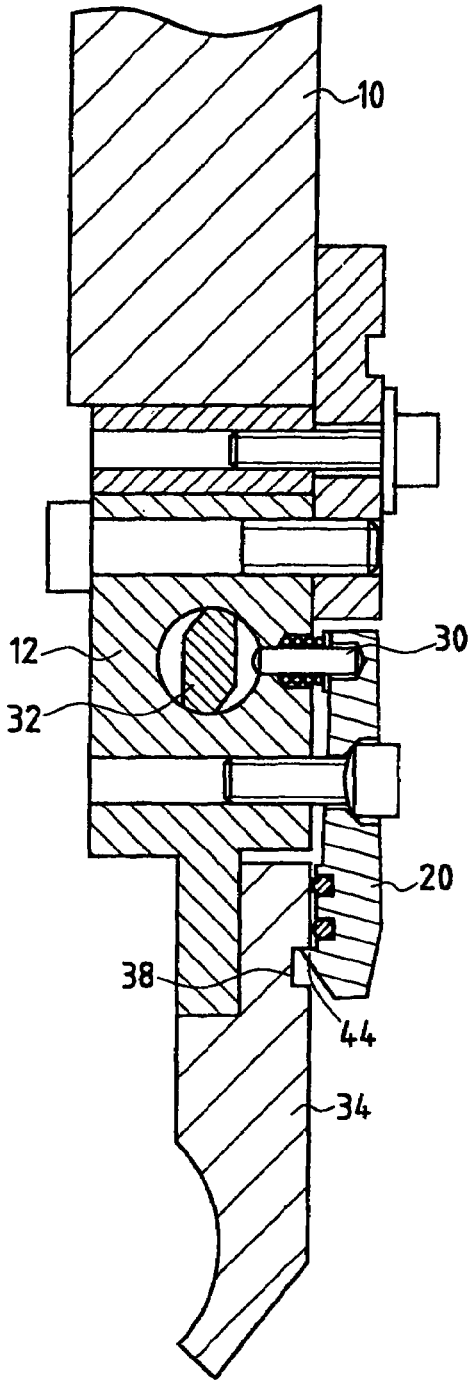
FIG.1B PRIOR ART

It is important to point out right now that the clamp 20 at its lower end 42 does not have the retaining nib 44 of FIG. 1A.

FIG. 2 also depicts the bending tool 34 with its fixing heel 36 and its retaining groove 38. The fixing heel 36 comprises two fixing faces 36*a* and 36*b* able to collaborate with the clamping face 14*a* of the tool spacer and the clamping face of the clamp, as will be explained.

In the embodiment described, the lower part of the clamp 42 in its face facing toward the tool spacer comprises two inserts in the form of longitudinal strips 50 and 52 defining a clamping surface with the same function as the clamping surface 40 of the clamp 20 depicted in FIG. 1A.

It will be understood that the clamp 20 can pivot between a first, fixing position in which the heel 36 of the tool is clamped between the extension 14 of the tool spacer and the clamping surface consisting of the strips 50 and 52 and a second position of the clamp 20, for mounting/dementing, in which position the clamping surfaces 50, 52 are separated from the heel 36 of the bending tool.

According to the invention, retention of the bending tool is obtained by a retaining member bearing the general reference 54 and depicted in greater detail in FIG. 5. This retaining member 54 preferably consists of an elastically deformable metal plate 56 in which elastically deformable blades 58 are defined. Each elastically deformable blade 58 is separated from the adjacent blades by a slot 60.

The width l of each elastically deformable blade is determined in relation to the lengths of the bending tools themselves, according to the length of the bending machine, so that each blade 58 presses against the heel of just one bending tool.

As best shown in FIG. 2, each blade 58 comprises a first fixing end 58*a* fixed by any appropriate means 62 to the tool spacer 12, a running part 58*b* and a retaining end 58*c*. At rest, that is to say when the blade 58 is not deformed and when the tool is mounted, its running part 58*b* is pressed against the fixing face 36*a* of the heel 36 of the tool. The retaining end 58*c* of each blade 58 is arranged in such a way that it can enter the groove 38 of the heel of the tool when the latter is in the fixing position on the tool spacer 12.

As best shown in FIGS. 3 and 4, the retaining part 58*c* of each blade 58 comprises a first angled part 64 which makes, for example, an angle of the order of 450 with respect to the direction of the running part 58*b* of the blade. The angling is such that this portion can enter the groove 38 of the heel of the bending tool. The retaining part also comprises a second angled portion 66 angled in the opposite direction, so that the angled portions 64 and 66 together form an open V of vertex A. The bend 68 which connects the flat running part 58*b* to the first angled portion 64 is defined in such a way that, at rest, the chamfer 70 that connects the fixing face 36*a* of the heel of the tool to the upper wall 72 of the groove 38 presses against the first end of the angled portion 64. Of course, the angled portions 64, 66 are defined in such a way that the angled portions can entirely enter the groove 38.

The lower end 58*c* of each blade 58 additionally comprises an alignment portion 76 roughly parallel to the running part 58*b* of the blade and connected to the end of the second angled portion 66 by a roughly horizontal connecting portion 78. As FIGS. 3 and 4 show, the lower end 42 of clamps 20, 20' is equipped with a longitudinal groove 80 formed in the lower face 20*a* of the clamp and running the length of the clamp. The alignment groove 80 is able to take the end 76*a* of the alignment portion 76. The width l' of the alignment groove 80 is such that, when the clamp is in the clamped position, the alignment portion 76 is not in contact with any of the vertical walls 80*a*, 80*b* of the alignment groove and so that, when the clamp is in the mounting/dementing position depicted in FIG. 4, the end of the alignment portion 76 is pressed against the vertical wall 80*a* of the groove 80, which wall is closest to the heel of the tool.

It will be understood that, when the clamp 20 is in its clamped position as depicted in FIG. 3, the running part 58*b* transmits to the fixing face 36*a* of the heel of the tool all of the clamping force produced by the fixing surfaces 50 and 52 of the clamp.

When the clamp 20 is brought into its mounting/dementing position as depicted in FIG. 4 and no force is applied to the bending tool 34, the stiffness of the blade 58 is enough for its running part 58*b* to be kept against the fixing face 36*a* of the heel of the tool and for the angled portions 64 and 66 to remain engaged in the groove 38 of the heel of the tool. In other words, the stiffness of the blade 58 is enough to compensate for the weight of the tool. Effective retention of the tool is thus obtained when the clamp 20 is in this position.

When a downward force F is applied to the tool in order to demount it, the upper chamfer 70 of the groove 38 of the tool acts on the start of the upper angled portion 64 and through elastic deformation causes the elastic blade to move aside and the angled portions to gradually leave the groove 38. This result is of course obtained by virtue of the angling of the portion 64. When the chamfer 70 comes into contact with the vertex A of the two angled portions, the retention effect no longer exists and the tool can be removed.

It will be understood that, when there is a wish to fit the tool, the outer upper corner 82 of the heel 36 of the tool comes into contact with the lower part of the angled portion 66 of the blade 58. This upper corner, preferably chamfered, 82, causes the entire blade 58 to move away progressively until the vertex A of the angled portions 64 and 66 comes into contact with the fixing face 36*a* of the heel of the tool. When the tool has been raised enough for the vertex A of the angled portions to come to face the upper part of the groove 38 as the tool is gradually raised, the angled portions 64 and 66 enter the groove 38 until the tool 34 arrives in its fixed position depicted in FIG. 4. In this position, the angled portions 64, 66 fully perform their retaining function. To fix the tool to the upper beam all that is then required is for the clamp 20 to be pivoted to return it to the position depicted in FIG. 2.

The function of the alignment portion 76 of the retaining end 58*c* of the elastically deformable blades 58 will now be explained. The end 76*a* of this portion enters the longitudinal groove 80 formed in the lower face of the clamp. As already explained briefly, this end 76*a* is not in contact with any of the vertical faces 80*a* and 80*b* of the groove when the clamp is in its clamped position depicted in FIG. 3. By contrast, when the clamp is brought into its mounting/dementing position depicted in FIG. 4, the end 76*a* of the alignment portion 76 comes into contact with the wall 80*a* of the groove 80. Thus, all the alignment ends 76 of the blades 58 are aligned on the position of the wall 80*a*. As a result, the vertices A of the angled portions 64, 66 of each blade are also aligned, making the tool easier to fit or to extract because all these vertices A are aligned.

This alignment of the vertices at the time of fitting of the tool avoids significant stressing of the deformable blades the vertices of which might not be suitably separated from the clamping face 14*a*.

FIG. 5, which depicts a preferred embodiment of the retaining member 54, depicts in the zone Z the portions of the elastically deformable blades 58 which deform elastically as the angled portions 64 and 66 of these blades are inserted into or extracted from the groove 38 of the heel of the bending tool 34.

The invention claimed is:

1. A system for fixing a bending tool, said tool including two parallel fixing surfaces for fixing by clamping and a retaining groove, said system comprising:

(a) a clamping body having a first clamping surface collaborating with one fixing surface of said tool;

(b) a tool clamp mounted so that it can pivot, said tool clamp having a second clamping surface, said tool clamp being moveable between a first tool-clamping position in which fixing surfaces of said tool are clamped between said first and second clamping surfaces and a second position, in which said second clamping surface is separated from said first clamping surface of said clamping body allowing mounting/dementing of said tool; and (c) a tool retaining member distinct from said clamping body including a number of mutually parallel elastically deformable blades arranged in a same plane, each blade having a first end directly secured to said clamping body in a fixed position, a running part arranged in such a way that, at rest, it is pressed against said first fixing face of said tool and a second end shifted with respect to said first clamping surface of said clamping body, said second end having at least a first angled part angled toward said tool with respect to said running part and a second angled part angled in an opposite direction whereby said angled parts, when said blade is at rest, remain engaged in said retaining groove of said tool and whereby, when said clamp is in said second position, said running part of said each blade allows said angled parts of said each elastically deformable blade to be introduced into or extracted from said retaining groove.

2. A fixing system according to claim 1, wherein when said clamp is in said tool-dismounting second position, an assembly constituted by said two angled parts are suitable for deforming under effect of pivoting of said tool so that an end of said second angled part becomes disengaged from said retaining groove.

3. A fixing system according to claim 1, wherein said second angled part includes a main portion and said end of said second angled part forms an angle with said main portion.

4. A fixing system according to claim 1, wherein said top edge of said retaining groove is chamfered.

5. A fixing system according to claim 1, wherein when said clamp is brought into its clamping position, said retaining member exerts a force having a vertical component on said tool.

6. A fixing system according to claim 1, wherein said end of said second angled part comes into abutment against the top edge of said retaining groove whatever said position of said clamp.

* * * * *